US007114198B1

(12) United States Patent
Hsieh et al.

(10) Patent No.: US 7,114,198 B1
(45) Date of Patent: Oct. 3, 2006

(54) HELMET ATTACHMENT

(76) Inventors: Abigail S. Hsieh, 9322 Glen Rd., Potomac, MD (US) 20854; Edward S. Lu, 4127 Amherst St., Houston, TX (US) 77005

( * ) Notice: Subject to any disclaimer, the term of this patent is extended or adjusted under 35 U.S.C. 154(b) by 56 days.

(21) Appl. No.: 10/921,316

(22) Filed: Aug. 19, 2004

(51) Int. Cl.
*A42B 1/24* (2006.01)

(52) U.S. Cl. ..... 2/422; 2/411; 2/425; 2/909

(58) Field of Classification Search ..... 2/424, 2/422, 410, 425, 171, 411, 209.13, 175.3, 2/244, 246, 909, 900; 40/329, 586; 446/27; D2/895, 891, 870, 878, 866; D29/102, 103, D29/106
See application file for complete search history.

(56) References Cited

U.S. PATENT DOCUMENTS

D167,789 S * 9/1952 Adams ..... D29/106
D167,790 S * 9/1952 Adams ..... D29/106
D167,791 S * 9/1952 Adams ..... D29/106
D174,517 S * 4/1955 Schwartz ..... D2/872
D179,967 S * 4/1957 Erickson ..... D29/104
3,216,149 A * 11/1965 Briese ..... 446/27
D208,351 S * 8/1967 Harmer ..... D29/122
3,381,308 A * 5/1968 Fineberg ..... 2/182.6
3,395,702 A * 8/1968 White ..... 128/866
4,776,043 A * 10/1988 Coleman ..... 2/209.12
5,323,492 A * 6/1994 DeMars ..... 2/209.13
5,508,900 A * 4/1996 Norman ..... 362/106
5,771,493 A * 6/1998 Proctor ..... 2/209.13
5,903,925 A * 5/1999 Engebretson ..... 2/209.13
5,903,927 A * 5/1999 Wolfe et al. ..... 2/209.13
6,000,063 A * 12/1999 Sullivan ..... 2/209.13
6,029,280 A * 2/2000 Sloot ..... 2/243.1
D422,777 S * 4/2000 Scott ..... D2/869
6,101,636 A * 8/2000 Williams ..... 2/410
D442,746 S * 5/2001 Belcher ..... D29/122
6,237,162 B1 * 5/2001 Gill ..... 2/422
D454,678 S * 3/2002 Graves et al. ..... D2/872
6,401,249 B1 * 6/2002 Haar et al. ..... 2/69
6,718,559 B1 * 4/2004 Davidson ..... 2/422
6,848,122 B1 * 2/2005 Meeds ..... 2/422
2004/0123375 A1 * 7/2004 Walters ..... 2/171
2005/0078473 A1 * 4/2005 Zuloff ..... 362/106

* cited by examiner

*Primary Examiner*—Rodney M. Lindsey

(57) ABSTRACT

A helmet attachment includes a structure representing at least one of an animal feature, an insect feature, a historical helmet feature, mythical creature part, and a vehicle feature. The helmet attachment further includes an attachment mechanism for securing the structure to a surface of a helmet.

7 Claims, 4 Drawing Sheets

HELMET ATTACHMENT

TECHNICAL FIELD

The invention generally relates to protective helmets and, more particularly, to attachments for the outside of helmets.

BACKGROUND

Because of safety concerns, individuals, especially children, are increasingly using protective helmets for activities such as, for example, skiing, roller blading, ice skating, and bicycling. Helmets, however, are only available in limited styles and colors. As a result, it is often difficult for parents to identify their children from others with similar helmets. Moreover, those wearing helmets may not be able to express their individuality with off-the-shelf helmets that are identical to many others in style and color.

Thus, there is a need to overcome these and other problems of the prior art and to provide helmet attachments that allow wearers to personalize their helmet without compromising the helmets structural integrity or adding excessive weight.

SUMMARY OF THE INVENTION

In various embodiments, there is provided a helmet attachment including a structure representing at least one of an animal feature, an insect feature, a historical helmet feature, mythical creature part, and a vehicle feature. The helmet attachment further includes an attachment mechanism for securing the structure to a surface of a helmet.

In other various embodiments, there is provided a helmet attachment including a structure representing at least one of a shark fin, a pair of horns, a camel hump, and a car spoiler, wherein the structure comprises a polymeric material. The helmet attachment further includes an attachment mechanism for securing the structure to a surface of a helmet.

BRIEF DESCRIPTION OF THE DRAWINGS

The accompanying drawings, which are incorporated in and constitute a part of this specification, illustrate embodiments of the invention and, together with the description, serve to explain the objects, advantages, and principles of the invention.

In the drawings.

DETAILED DESCRIPTION

In the following description, reference is made to the accompanying drawings that form a part thereof, and in which is shown by way of illustration a specific exemplary embodiment in which the invention may be practiced. This embodiment is described in sufficient detail to enable those skilled in the art to practice the invention and it is to be understood that other embodiments may be utilized and that changes may be made without departing from the scope of the present invention. The following description is, therefore, not to be taken in a limited sense.

Figure 1:
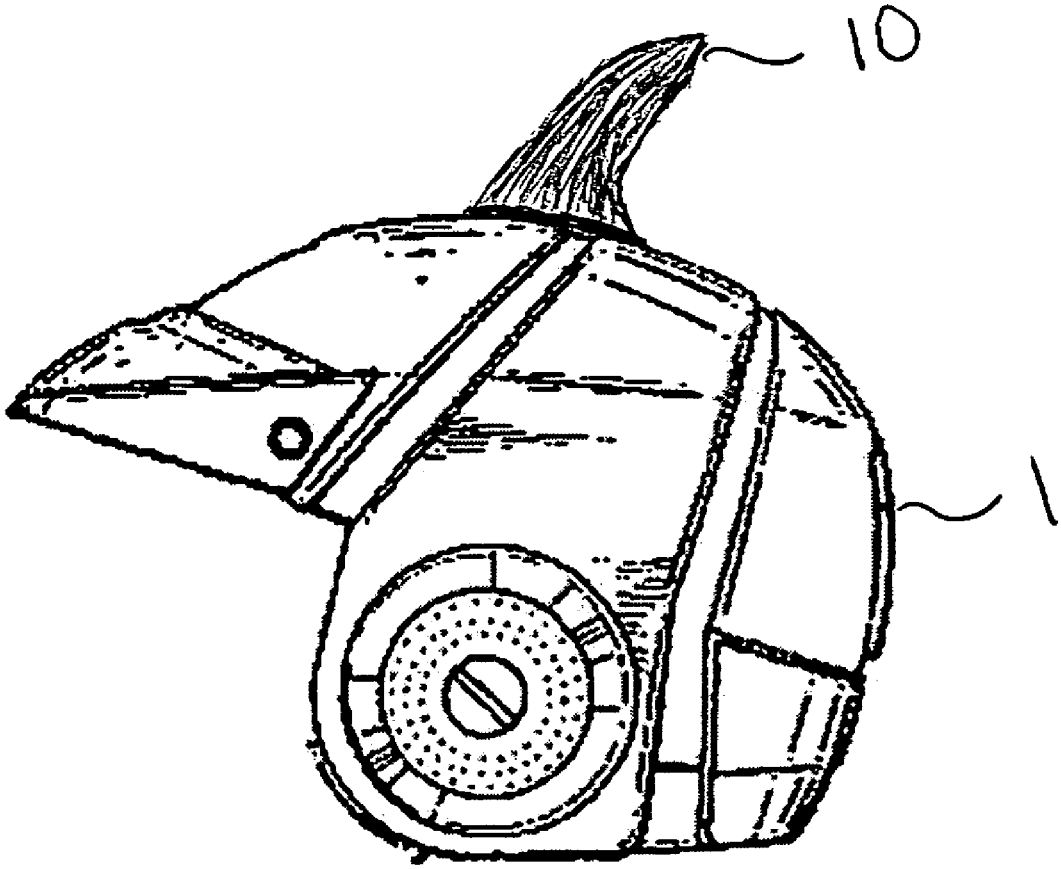
FIG. 1 depicts a helmet attachment in accordance with an exemplary embodiment of the invention.
Figure 2:
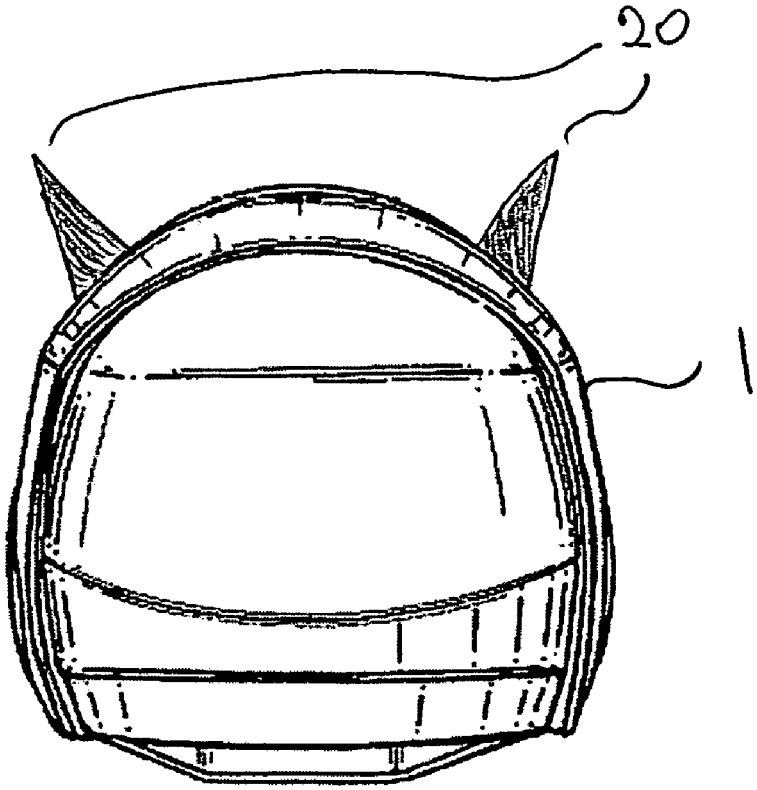
FIG. 2 depicts another helmet attachment in accordance with an exemplary embodiment of the invention.
Figure 3:
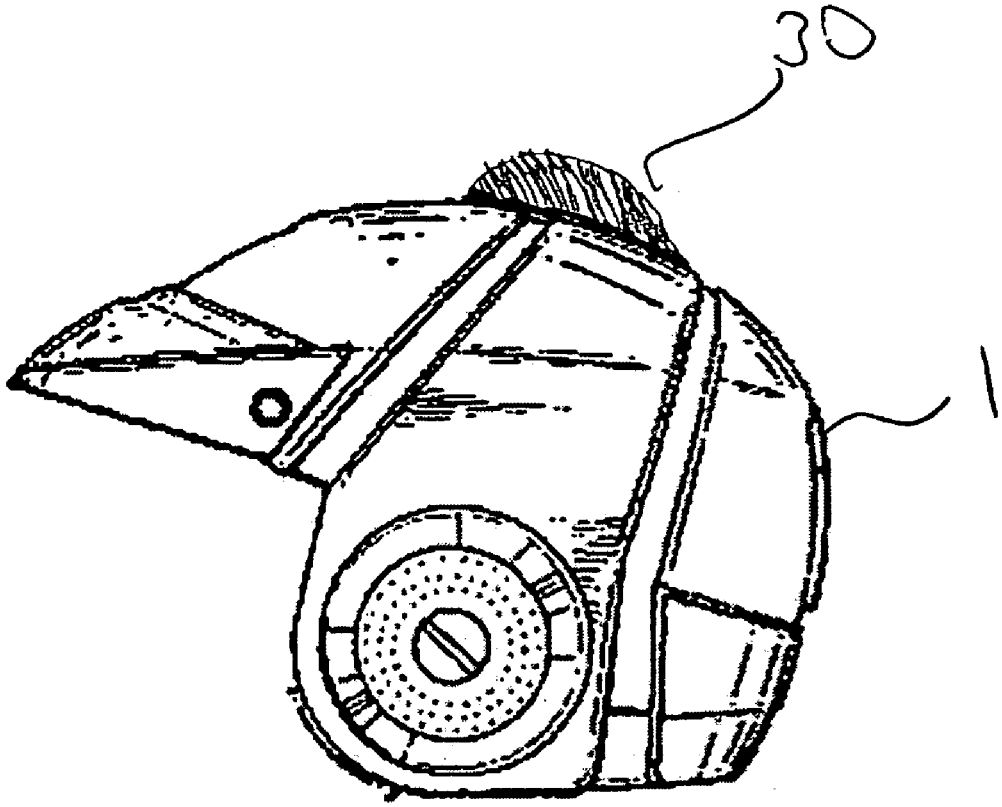
FIG. 3 depicts another helmet attachment in accordance with an exemplary embodiment of the invention.
Figure 4:
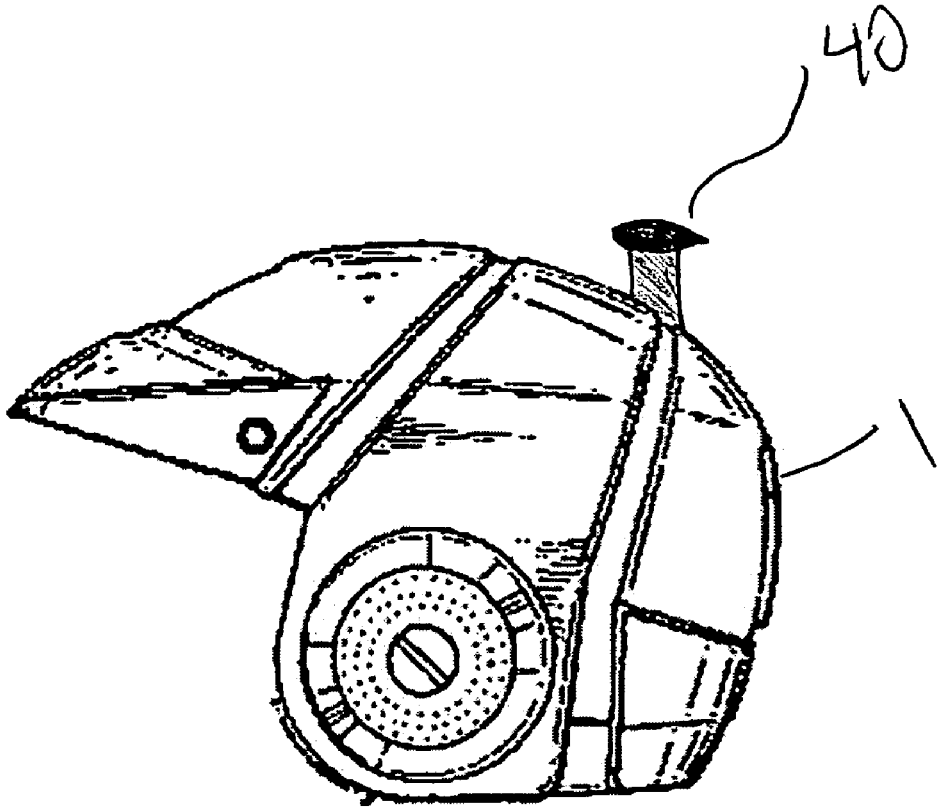
FIG. 4 depicts yet another helmet attachment in accordance with an exemplary embodiment of the invention.

FIGS. 1–4 disclose a helmet attachment in accordance with an exemplary embodiment of the present invention. In various embodiments, the attachment includes an identifiable structure and an attachment mechanism.

In an embodiment, the invention includes an identifiable structure and a mechanism to attach the identifiable structure to the outside of a helmet. The identifiable structure is a three dimensional representation of any recognizable structure, such as, for example, an animal feature, an insect feature, a historical helmet feature, mythical creature part, and a vehicle feature. Animal features and mythical creature parts can include, but are not limited to, horns, tails, legs, trunks, heads, humps, hind quarters, snouts, and the like. Insect features can include, but are not limited to, antennae, heads, tails, wings, stingers, legs, and the like. Vehicle features include, but are not limited to, airplane parts such as wings, nose section, cockpit, and tail section, boat parts, such as rudders, masts, sails, motors, and hulls, and road vehicle parts, such as, wheels fenders, trunks, hoods, and spoilers. The identifiable structure can also mimic a historical helmet, such as for example, a Viking helmet and the like. In various embodiments, helmet 1 can include identifiable sturcture, such as, for example, a shark fin 10 shown in FIG. 1, devil's horns 20 shown in FIG. 2, a camel hump shown in FIG. 3, and a car spoiler 40 shown in FIG. 4. Other structures can include, for example, Viking horns and a unicorn horn. The exemplary identifiable structure is attached to the outside of the helmet in an appropriate location. The identifiable structure can be made of any suitable material, such as, for example, a polymeric material, but preferably the material should be deformable, soft, or inflatable. The material should be lightweight so that the identifiable structure does not add significant weight to the helmet making it uncomfortable to use. For example, shark fin 10 in FIG. 1 can be made of foam or plastic, camel hump 30 in FIG. 3 can be made of bristles or fibers, and car spoiler 40 of FIG. 4 can be made of rubber. Other suitable materials are known to those of skill in the art.

The size of the identifiable structure can vary, if desired, in relation to the size of the helmet and attachment mechanism. The color of the identifiable structure can be any color desired.

The identifiable structure may be attached to the helmet by any suitable mechanism, such as, for example, double sided tape, Velcro, or glue. The attachment mechanism must secure the identifiable structure to an outside portion of the helmet and prevent it from falling off the helmet during participation in the associated activity. Preferably, the mechanism for attachment allows removal of the identifiable structure from the helmet and re-attachment as desired.

It will be apparent to those skilled in the art that various modifications and variations can be made in the disclosed process without departing from the scope or spirit of the invention. Other embodiments of the invention will be apparent to those skilled in the art from consideration of the specification and practice of the invention disclosed herein. It is intended that the specification and examples be considered exemplary only, with a true scope of the invention being indicated by the following claims.

What is claimed is:

1. In combination an impact resistant protective helmet expected to receive an impact and a helmet attachment removeably attached to a portion of an exterior surface of the impact resistant protective helmet, said helmet configured for use during bicycling or skiing, the attachment for providing a unique appearance to the impact resistant protective helmet configured for use during bicycling or skiing, the helmet attachment comprising:

a structure representing at least one of an animal feature, an insect feature, a historical helmet feature, a mythical creature part, and a vehicle feature, wherein the structure comprises a deformable polymeric material; and a hook and loop attachment mechanism for securing the structure to just a portion of an exterior surface of the impact resistant protective helmet, wherein the hook and loop attachment mechanism allows removal and reattachment of the structure.

2. The helmet attachment of claim 1, wherein the animal feature is at least one of a pair of horns, a single horn, a pair of wings, and a hump, a tail, a set of legs, a trunk, a head, a hind quarter, and a snout.

3. The helmet attachment of claim 1, wherein the insect feature is at least one of an antenna, a head, a tail, a pair of wings, a stinger, and a set of legs.

4. The helmet attachment of claim 1, wherein the structure mimics a historical helmet feature.

5. The helmet attachment of claim 1, wherein the structure is inflatable.

6. The helmet attachment of claim 1, wherein the structure comprises at least one of a foam, fibers, a rubber, and a plastic.

7. The helmet attachment of claim 1, further comprising a coloring to make the structure appear similar to the at least one of a shark fin, a pair of horns, a camel hump, and a car spoiler.

* * * * *